United States Patent [19]

Paquet

[11] Patent Number: 4,607,468

[45] Date of Patent: Aug. 26, 1986

[54] ELEMENT FOR DOOR OR WINDOW OR OUTSIDE-WALL PANEL FORMED IN PARTICULAR OF TWO FLAT PANELS SEPARATED BY A GAS WITH COMPENSATED VARIATION OF VOLUME

[75] Inventor: Claude Paquet, Laval, France

[73] Assignee: Vitrages Isolants de l'Ouest, France

[21] Appl. No.: 651,254

[22] Filed: Sep. 17, 1984

[30] Foreign Application Priority Data

Sep. 15, 1983 [FR] France ..... 83 14724

[51] Int. Cl.[4] ..... E06B 7/12

[52] U.S. Cl. ..... 52/172; 52/573; 52/399; 52/790

[58] Field of Search ..... 52/171, 172, 788, 790, 52/479, 573, 398, 399

[56] References Cited

U.S. PATENT DOCUMENTS

| | | | |
|---|---|---|---|
| 3,928,953 | 12/1975 | Mazzoni et al. | 52/172 |
| 4,407,105 | 10/1983 | Frank | 52/171 X |

FOREIGN PATENT DOCUMENTS

| | | | |
|---|---|---|---|
| 0072062 | 2/1983 | European Pat. Off. | 52/788 |
| 1226767 | 3/1961 | Fed. Rep. of Germany | 52/171 |
| 2350602 | 4/1975 | Fed. Rep. of Germany | 52/171 |
| 2730119 | 1/1979 | Fed. Rep. of Germany | 52/171 |
| 2935982 | 2/1981 | Fed. Rep. of Germany | 52/171 |
| 3102921 | 8/1982 | Fed. Rep. of Germany | 52/171 |
| 1405364 | 5/1965 | France | 52/171 |
| 522813 | 6/1972 | Switzerland | 52/171 |
| 1117028 | 6/1968 | United Kingdom | 52/172 |

*Primary Examiner*—Carl D. Friedman
*Assistant Examiner*—Naoko N. Slack
*Attorney, Agent, or Firm*—Fred A. Keire

[57] ABSTRACT

An element for doors or windows, which has panels spaced by a spacer forming a gas filled chamber therebetween, includes an automatically variable volume placed within the chamber; the automatically variable volume is formed by a peripheral spacer and a deformable flexible membrane integral with the spacer.

10 Claims, 5 Drawing Figures

ELEMENT FOR DOOR OR WINDOW OR OUTSIDE-WALL PANEL FORMED IN PARTICULAR OF TWO FLAT PANELS SEPARATED BY A GAS WITH COMPENSATED VARIATION OF VOLUME

The present invention relates to an element for construction, formed of two flat panels, in particular two transparent panes of glass, separated by a gas whose change in volume is automatically compensated for.

Insulating windows are known which are formed of two panes of glass arranged at a distance from each other and separated by a space containing a dehydrated, immobile, colorless gas of low thermal conductivity. This gas is generally air.

There are also known blinds which can be folded in accordion shape and arranged between two plates of glass separated by a dehydrated air space. However these blinds which are lowered at night to avoid loss of heat and raised during the day to permit utilization of the sun's rays during the day, require an air space of substantial thickness in order to permit the blind to be placed therein. Now, when the temperature varies, the volume of the gas varies to an extent which is not negligible. This change in volume, particularly when the temperature reaches more than 30° C. may result in stresses on the gaskets used to imprison the air between the two plates of glass and this may result in a leak within a short time.

The present invention is directed at overcoming these drawbacks.

One object of the invention is to provide an element for a window, door or outside-wall panel consisting of at least two panels, an air space being present between these panels and the distance between the panels and therefore the thickness of the air space being substantial, without changes in the volume of this air space causing stresses on the element.

For this purpose, the invention concerns an element formed of at least two panels which are spaced apart from each other and connected together by a peripheral spacer, the inner free chamber being filled with a gas which contains integrated means which make it possible to take up the variations in volume of the gas.

Such integrated means consist preferably of an automatically variable volume placed within the inner free chamber. The volume is formed, on the one hand, by a peripheral spacer and, on the other hand, by a flexible peripheral membrane.

The membrane forms an integral part of the spacer, namely the spacer and the membrane form a single piece one part of which is rigid, namely the spacer, while the other part is flexible and deformable, namely the membrane. The spacer and the membrane consist of synthetic material, the membrane having a Shore hardness which is less than the Shore hardness of the spacer.

The following description, read with reference to the accompanying drawings, which are given by way of illustration and not of limitation, will make it possible to understand how the invention can be reduced to practice.

Figure 1:
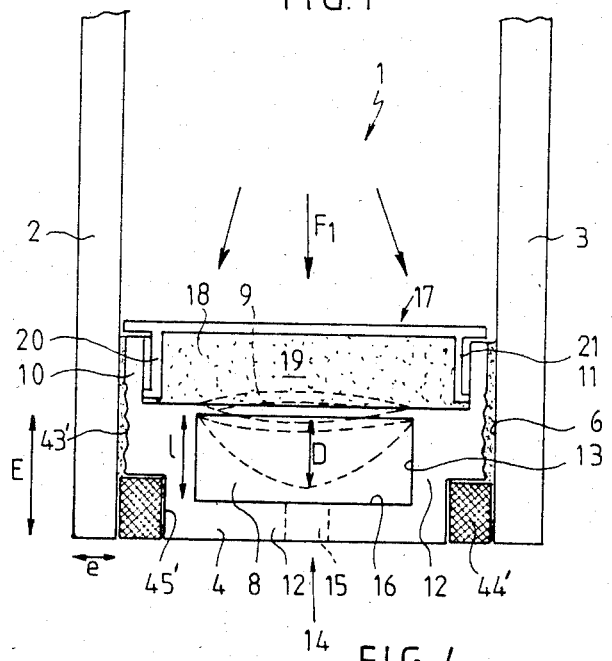
FIG. 1 is an enlarged, partial view in cross section of the element of the invention.
Figure 2:
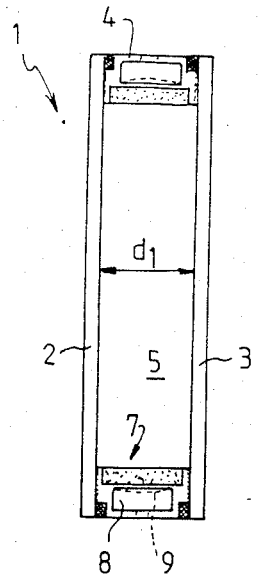
FIG. 2 is a cross sectional view of the element of the invention.
Figure 3:
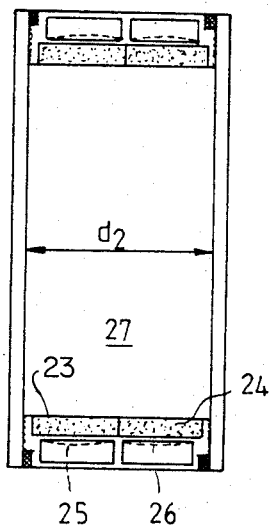
FIG. 3 is a cross sectional view of an element of a thickness twice the thickness of the element of FIG. 2.

The element 1 for doors or windows shown in FIGS. 1 and 2 is formed of at least two parallel panels 2 and 3 of thickness e. For example, the panels 2 and 3 are transparent plates of glass whose thickness may vary depending on the acoustic coefficient desired and the dimensions of the element. The panels 2 and 3 are spaced apart by a distance $d_1$ which is preferably equal to about 30 mm. The panels 2 and 3 are connected together in known manner by a peripheral spacer 4. This spacer 4 has, seen in longitudinal section, a pseudo-rectangular shape when the panels 2, 3 are of rectangular shape. The spacer 4 connects the extreme edges of the panels 2, 3. The free, inner chamber 5 formed by the spacer 4 and the panels 2, 3 is filled with a gas, preferably dehydrated air. The volume V of gas contained in the inner chamber 5 is variable as a function of the temperature of the gas. Thus if at a temperature of 25° C., the volume V is equal to the volume Vo, then at the temperature of 40° C. the volume V is equal to $V_1 > Vo$ and at a temperature of 0° C. the volume V is equal to $V_2 > Vo$. The spacer 4 and the panels 2, 3 are connected together by a gasket 6.

In accordance with the invention, the element 1 has integrated means 7 which make it possible to take up the variations in volume V of the gas. The integrated means are means which form part of the element, and more particularly internal means.

The integrated means 7 are formed of an automatically variable volume 8 placed in the inner, free chamber 5. This automatically variable volume 8 is formed by the peripheral spacer 4 and a flexible, deformable peripheral membrane 9.

In accordance with a preferred embodiment of the invention, the membrane 9 forms an integral part of the spacer 4.

For example, the spacer 4 and the membrane 9 are formed of different synthetic materials and extruded jointly. The membrane 9 is preferably formed of a flexible, synthetic material of a Shore hardness which is less than the Shore hardness of the synthetic material constituting the spacer 4.

When the volume V increases, the membrane is pushed by the pressure exerted by the expansion of the gas, as indicated by the forces $F_1$ directed from the inside to the outside of the element. Its maximum displacement D, namely the distance between the position of the membrane 9 when the gas is not undergoing any change in volume and the position of the membrane when the gas undergoes a change in volume V max, is limited by the automatically variable volume 8.

The volume 8 is preferably formed by the membrane 9 and by the spacer 4 which in cross section has the shape of a pseudo U, comprising two flanges 10, 11 and a web 12 of thickness E. The web 12 of the U has a cut-out 13 which is pseudo-rectangular in cross section. Thus the thickness E of the web 12 must be greater than the width l of the cut-out 13, this width l being substantially equal to the displacement D of the membrane 9. The membrane 9 is continuous and airtight on the periphery of the spacer 4.

Finally, the spacer 4 has means 14 for the entrance and exit of gas into and from the cut-out 13. These means 14 preferably consist of an orifice 15 which permits communication between the cut-out 13 and the outside and therefore between the volume 8 and the outside. Thus when the volume V increases and the membrane 9 is displaced, the gas which is present between the membrane 9 and the inner walls 16 of the cut-out 13 is expelled to the outside by the pressure exerted by the membrane 9. In accordance with another embodiment of the invention, the means 14 are formed of an orifice located at the level of the bevel of the spacer 4.

When the volume V decreases, the gas, namely the air, penetrates through the orifice 15 in order to compensate for the vacuum resulting from the contraction of the gas present in the chamber 5.

In accordance with a preferred embodiment of the invention, a cover 17 of pseudo-U shape is held between the flanges 10, 11 of the spacer 4. Within the container 18 formed between the flanges 10, 11 and the cover 17, there is a dehydrating agent 19. The cover 17 preferably itself is of U shape with bottom 20 and two flanges 21, 22.

The two U's of the spacer 4 and of the cover 17 are located in such a manner that the flanges 21, 22 cooperate with the flanges 10, 11.

In accordance with another embodiment of the invention, spacers 23, 24 are placed alongside of each other, they having integrated means 25, 26, such as described above, which make it possible to compensate for the variations in the volume of the gas present in the chamber 27 formed by the two panels 2, 3 and the spacers 23, 24. The distance $d_2$ between the two panels 2, 3 is then equal to $2d_1$.

Figure 4:
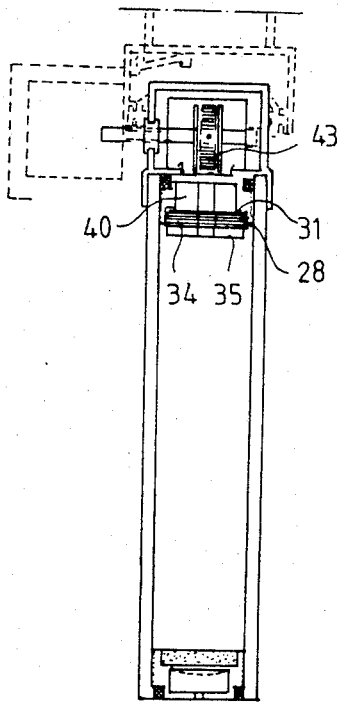
FIG. 4 is a cross sectional view of the element of FIG. 2 containing the blind.
Figure 5:
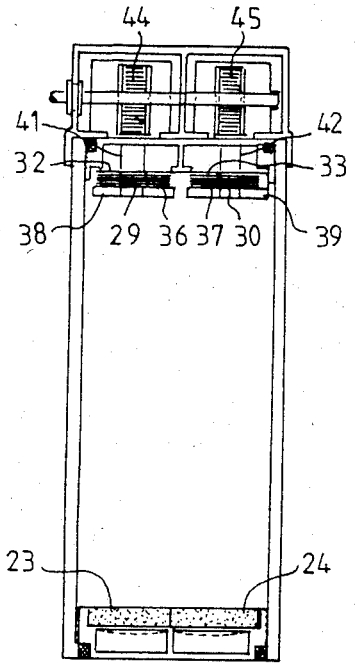
FIG. 5 is a sectional view of the element of FIG. 3 containing two blinds.

In accordance with another embodiment, shown more particularly in FIGS. 4 and 5, a foldable blind 28 (or two blinds 29, 30) one end 31 of which is fastened to the spacer 4 (or one end 32, 33 of the spacers 29, 30 being fastened to the spacers 23, 24 respectively) and the opposite end 34 of which bears a weighting bar 35 (or the opposite ends 36, 37 each bearing a bar 38, 39 respectively). Each bar (35, 38, 39) is lifted by the action of a wire 40, 41, 42 which is wound around a drum (43, 44, 45).

The foldable blinds (28, 29, 30) are placed between the two panels (2, 3).

Finally the element according to the invention has a double barrier seal. The first barrier consists of a cord 43' of polyisobutylene which, extruded hot and compressed, is placed between the flanges 10, 11 of the spacer 4 and the panels 2, 3. A second barrier is formed by a silicone gasket 44' placed within a groove 45' produced on the outer edges of the spacer 4, between the spacer 4 and the panels 2, 3.

The panels 2, 3 preferably consist of panes of transparent glass, which may or may not be tinted, while the gas contained within the space 5 is dehydrated air.

The element of the invention is particularly suitable for buildings such as dwellings and permits of excellent heat insulation as well as the use of the energy contributed by the sun rays during the day (blind raised) and the slowing down of losses of energy during the night (blind lowered).

I claim:

1. An element for doors, windows or outside-wall panels which is flat and formed of at least panels (2, 3) which are spaced apart from each other and connected together by a peripheral spacer (4) and forms an inner free chamber therebetween, the inner free chamber (5) being filled with gas, comprising integrated means (7) which make it possible to take up variations in volume of the gas, consisting of an automatically variable volume placed within the inner free chamber, the automatically variable volume being formed, on the one hand, by the peripheral spacer and, on the other hand, by a deformable flexible membrane (9) wherein the membrane forms an integral part of the spacer.

2. An element according to claim 1 wherein the spacer (4) is rigid.

3. An element according to claim 1 wherein the spacer (4) and the membrane (9) are made of a synthetic material, the membrane (9) having a Shore hardness less than that of the spacer.

4. An element according to claim 1 wherein, in cross-section, the spacer (4) has the shape substantially of a U formed of a web (12) and two flanges (10, 11), the web (12) being of a thickness greater than a displacement D of the membrane (9).

5. An element according to claim 4, wherein the web (12) of the U has a cut-out (13) which is pseudo rectangular in cross section, permitting the displacement D of the membrane.

6. An element according to claims 5 wherein the spacer (4) has inlet and outlet means (14) for the gas, preferably air, in a cut-out (13).

7. An element according to claim 6, wherein the inlet and outlet means (14) are formed by an orifice (15) which permits communication between the cut-out (13) and the outside.

8. An element according to claim 7 wherein the orifice 15 is located at the level of the bevel of the spacer (4).

9. An element according to claim 1 wherein a cover (17) in the shape of a pseudo U is fitted between the flanges (10, 11) of the spacer (4) and that a dehydrating agent (19) is present in a container (18) thus formed.

10. An element according to claim 1 comprising at least two peripheral spacers (23, 24) placed side by side and each having integrated means (25, 26) which permit the taking up of variations in volume of the gas, at least one foldable blind arranged between the two panels (3,4), a first and a second sealing barrier between the panels and the spacer, the first sealing barrier being formed of a cord (43) of polyisobutylene which is extruded hot and compressed and the second sealing barrier being formed by a silicone gasket.

* * * * *